US005929739A

United States Patent [19]

Totsuka

[11] Patent Number: 5,929,739

[45] Date of Patent: Jul. 27, 1999

[54] FUSIBLE LINK

[75] Inventor: Mitsuhiko Totsuka, Shizuoka, Japan

[73] Assignee: Yazaki Corporation, Tokyo, Japan

[21] Appl. No.: 08/889,095

[22] Filed: Jul. 7, 1997

[30] Foreign Application Priority Data

Jul. 9, 1996 [JP] Japan ..... 8-719455

[51] Int. Cl.[6] ..... H01H 85/02; H01H 85/24; H01H 85/36; H01H 85/52

[52] U.S. Cl. ..... 337/198; 337/260; 337/264; 337/295; 337/201; 337/190; 337/216

[58] Field of Search ..... 337/198, 159, 337/197, 142, 186, 190, 195, 219, 238–240, 260, 261, 295, 401, 405, 407, 414, 415

[56] References Cited

U.S. PATENT DOCUMENTS 4,871,990 10/1989 Ikeda et al. ..... 337/238
5,294,906 3/1994 Totsuka et al. ..... 337/260
5,631,620 5/1997 Totsuka et al. ..... 337/260
5,670,929 9/1997 Totsuka ..... 337/201

FOREIGN PATENT DOCUMENTS 64-33146 3/1989 Japan .
6-176681 6/1994 Japan ..... H01H 85/22

*Primary Examiner*—Leo P. Picard
*Assistant Examiner*—Anatoly Vortman
*Attorney, Agent, or Firm*—Morgan, Lewis & Bockius LLP

[57] ABSTRACT

A fuse includes a fuse element having a pair of terminal portions interconnected by a fusible portion, pivot pawls provided between the fusible portion and each of the terminal portions, seat surfaces respectively supporting the pivot pawls thereon, thereby holding the fuse element within an insulating housing, and pivotal movement-allowing spaces for allowing two portions of the fuse element, separated from each other when the fusible portion is melted, to be pivotally moved about the pivot pawls inside and outside the insulating housing.

5 Claims, 4 Drawing Sheets

FUSIBLE LINK

BACKGROUND OF THE INVENTION

1. Field of the Invention

This invention relates to a fusible link of the cartridge type used in a vehicle or the like, and more particularly to a structure in which a melted portion, formed as a result of the melting of the fuse, is prevented from being short-circuited.

2. Related Art

FIG. 4 shows one conventional fusible link of the cartridge type used in a vehicle. This fusible link 1 comprises a fuse element 3, an insulating housing 5 containing this fuse element 3, and a transparent cover 7 closing an open top of the insulating housing 5. The fuse element 3 includes a pair of terminal portions 9, leg plates 11 extending respectively from the terminal portions 9, and a fusible portion 13 interconnecting upper ends of the leg plates 11. A pair of through holes 17 are formed through a bottom wall 15 of the insulating housing 5, and retaining grooves 19 are formed respectively in those portions of the upper surface of the bottom wall 15 disposed adjacent respectively to the through holes 17.

In the fusible link 1, the fuse element 3 of an inverted U-shape (in which the terminal portions 9 have not yet been bent) is inserted into the insulating housing 5 through the open top thereof, and the terminal portions 9 are passed respectively through the through holes 17, as shown in FIG. 5. The terminal portions 9 of the fuse element 3, projecting outwardly from the insulating housing, are bent to be disposed parallel to the bottom wall 15, and resilient retaining piece portions 12 are projected inwardly respectively from the two leg plates 11, as shown in FIG. 6.

In the condition shown in FIG. 6, the fuse element 3 of the fusible link 1 is pushed into the insulating housing 5, so that the resilient retaining piece portions 12 are engaged respectively in the retaining grooves 19, and also the terminal portions 9 are held against the lower surface of the bottom wall 15, thereby fixing the fuse element 3 to the insulating housing 5 as shown in FIG. 4.

Incidentally, in a car, even when an engine is in a stopped condition, electric power is supplied to a clock and so on from a battery, and electric current is flowing through the fusible link 1 although its amount is very small. Under the circumstances, if opposed edges of a melted portion are moved toward each other to be again contacted with each other by vibrations or others when exchanging the melted fusible link 1, there has arisen a problem that the melted portion is subjected to so-called secondary short-circuiting. In the above fusible link 1, the fuse element 3 is fixed to the insulating housing 5 by the resilient retaining piece portions 12 and the terminal portions 9, and therefore the opposed edges of the melted portion are opposed to each other only with a gap formed therebetween when the fuse element is melted, and therefore there is a possibility that the above short-circuiting problem is encountered in the above fusible link 1. Furthermore, although the above fusible link 1 is provided with the transparent cover 7, the melting of the fuse element may not be confirmed with the eyes if a gap, formed as a result of the melting, is small, which leads to a possibility that the melted fuse is inadvertently installed.

The present invention has been made in view of the above problems, and an object of the invention is to provide a fusible link in which the short-circuiting is prevented when exchanging a fuse, and the melting of the fuse can be positively noticed.

The above object of the invention has been achieved by a fusible link comprising a fuse element having a pair of terminal portions interconnected by a fusible portion; pivot pawls provided between the fusible portion and each of the terminal portions; seat surfaces respectively supporting the pivot pawls thereon, thereby holding the fuse element within an insulating housing; and pivotal movement-allowing spaces for allowing two portions of the fuse element, separated from each other when the fusible portion is melted, to be pivotally moved about the pivot pawls inside and outside the insulating housing.

In the fusible link of this construction, when the fusible portion is melted, the fuse element is divided or separated into two portions by a melted portion, and the two portions of the fuse element, separated from each other, are held within the insulating housing, with the pivot pawls resting respectively on the seat surfaces, and therefore when the fusible link is lifted, these two portions of the fuse element are pivotally moved about the pivot pawls because of the weights of the terminal portions, so that the opposed edges of the melted portion are moved away from each other. In the melted fusible link, the terminal portions are inclined, and can be pivotally moved about the pivot pawls.

DETAILED DESCRIPTION OF THE PREFERRED EMBODIMENTS

A preferred embodiment of a fusible link of the present invention will now be described in detail with reference to the drawings.

Figure 1:
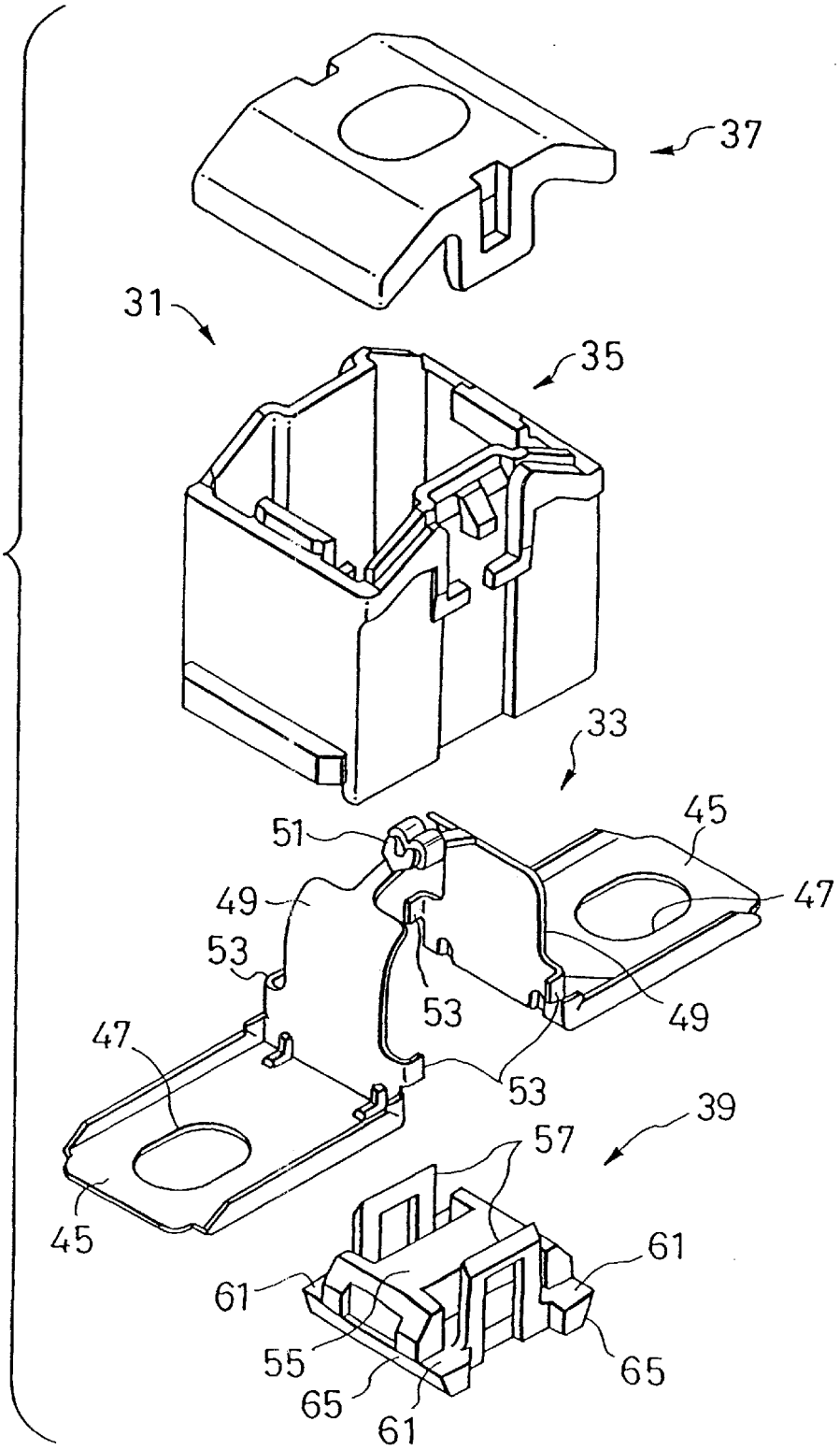
FIG. 1 is an exploded, perspective view of a fusible link of the present invention.
Figure 2:
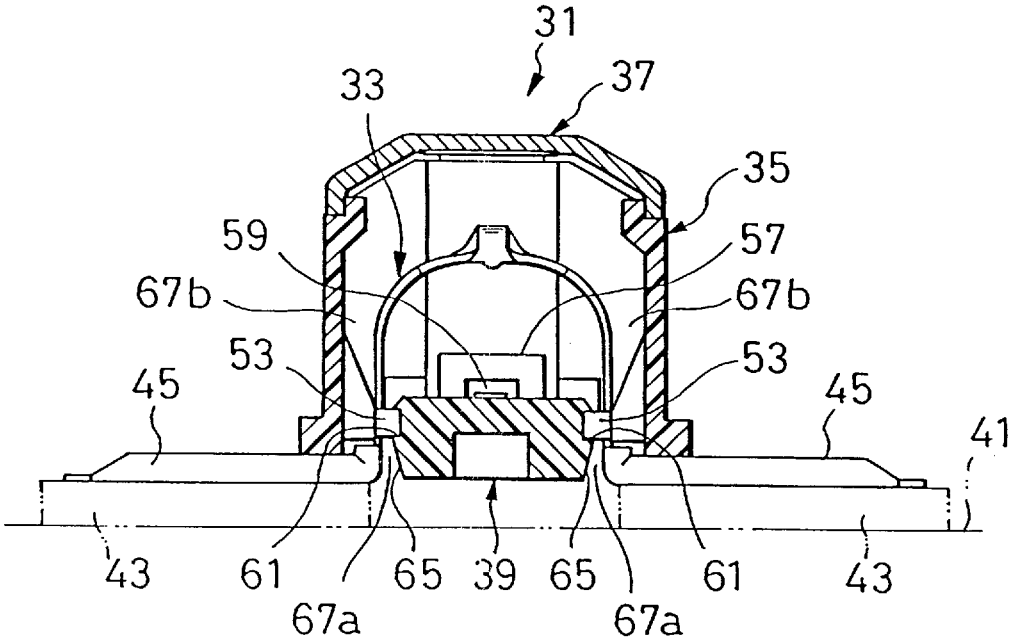
FIG. 2 is a vertical cross-sectional view of the fusible link he invention.

FIG. 1 is an exploded, perspective view of the fusible link of the invention, and FIG. 2 is a vertical cross-sectional view of the fusible link of the invention. The fusible link 31 comprises a fuse element 33, an insulating housing 35, a transparent cover 37 closing an open top of the insulating housing 35, and a spacer 39 closing an open bottom of the insulating housing 35.

The fuse element 33 includes a pair of terminal portions 45 to be mounted respectively on electrical connection portions 43 of a battery 41 which are disposed, for example, in a common plane. A mounting hole 47 is formed through each of the terminal portions 45 and 45, and the terminal portions 45 are fixedly secured respectively to the electrical connection portions 43 by bolts (not shown) passing respectively through the through holes 47. Leg plates 49, which are perpendicular to the terminal portions 45, extend upwardly respectively from opposed edges of the pair of terminal portions 45, and upper ends of the leg plates 49 are interconnected by a fusible portion 51. The fuse element 33 is symmetrical with respect to the fusible portion 51.

Pivot pawls 53 are formed at a lower end portion of each of the leg plates 49, and project perpendicularly to that side thereof (opposed face) facing the opposite leg plate 49. The pivot pawls 53 can be formed, for example, by bending projections, formed respectively on opposite side edges of the leg plate 49, perpendicularly to the opposed face.

After the fuse element 33 is inserted into the insulating housing 35 through the open bottom thereof, the spacer 39 can be inserted into this open bottom. A pair of retaining frames 57 are formed upright respectively on opposite sides of a square body 55 of the spacer. When the spacer 39 is inserted into the insulating housing 35 through the open bottom thereof, the retaining frames 57 are retainingly engaged respectively with projections 59 formed respectively on opposed inner surfaces of the insulating housing 35, and thus the spacer 39 is fitted in the open bottom of the insulating housing 35.

Flat seat surfaces 61 are formed respectively at four corners of an upper surface of the spacer 39 (beyond which the retaining frames 57 project upwardly). When the spacer 39 is fitted in the insulating housing 35, the seat surfaces 61 are abutted respectively against the pivot pawls 53 of the fuse element 33 from the lower side (from the lower side in FIG. 2). Therefore, the fuse element 33 is held within the insulating housing 35, with the pivot pawls 53 resting respectively on the seat surfaces 61.

Tapering or slanting surfaces 65 are formed respectively on opposite end surfaces of the spacer body 55 respectively facing the leg plates 49 of the fuse element 33. Each of the tapering surfaces 65 is slanting downwardly away from the associated leg plate 49. Formed between each tapering surface 65 and the associated leg plate 49 is a pivotal movement-allowing space 67*a* for allowing the pivotal movement of the leg plate 49.

The opposed inner surfaces of the insulating housing 35 is larger than the distance between the two leg plates 49 so that when the fuse element 33 is received within the insulating housing 35, a space (pivotal movement-allowing space) 67*b* can be formed between the outer surface of each leg plate 49 and the associated inner surface of the insulating housing 35.

Figure 3:
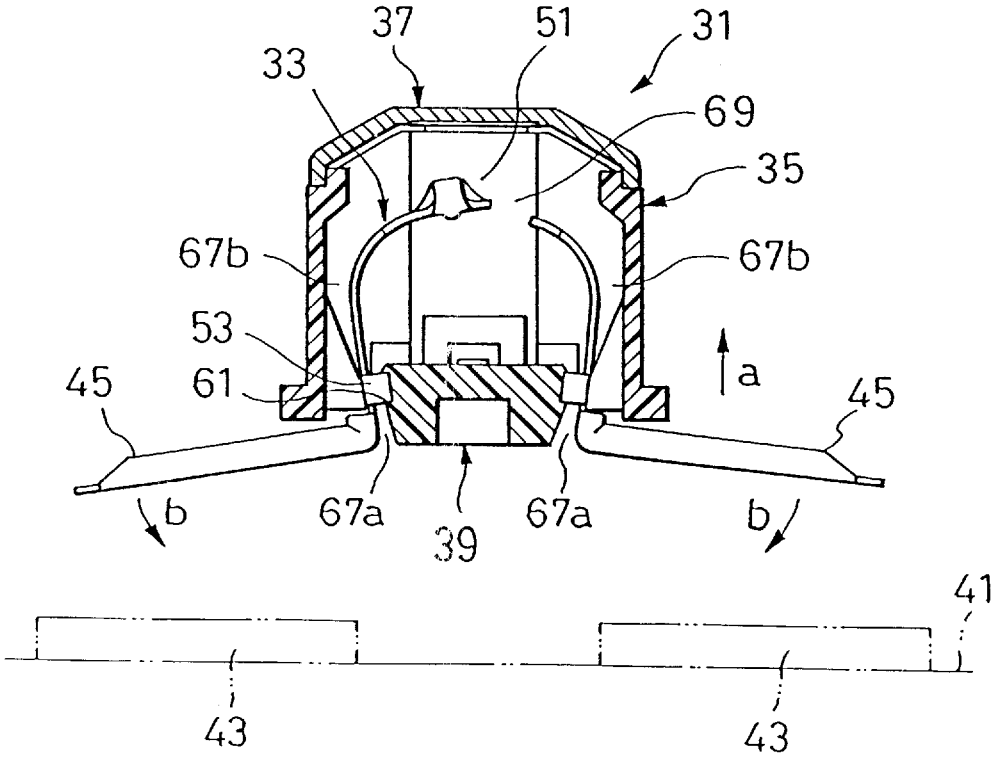
FIG. 3 is a vertical cross-sectional view showing a condition in which the fuse is melted.
Figure 4:
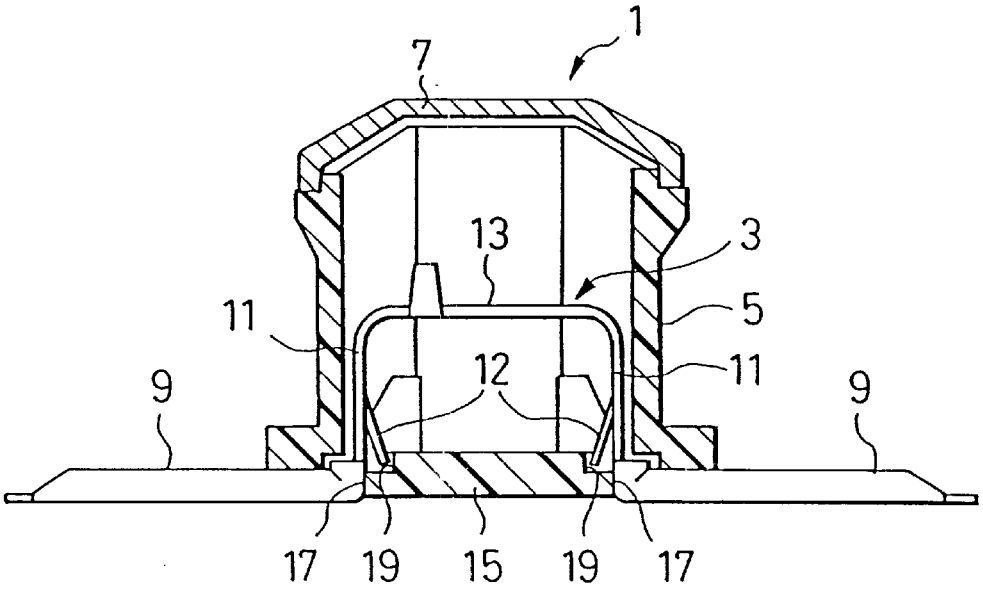
FIG. 4 PRIOR ART
FIG. 4 is a vertical cross-sectional view of a conventional fusible link.
Figure 5:
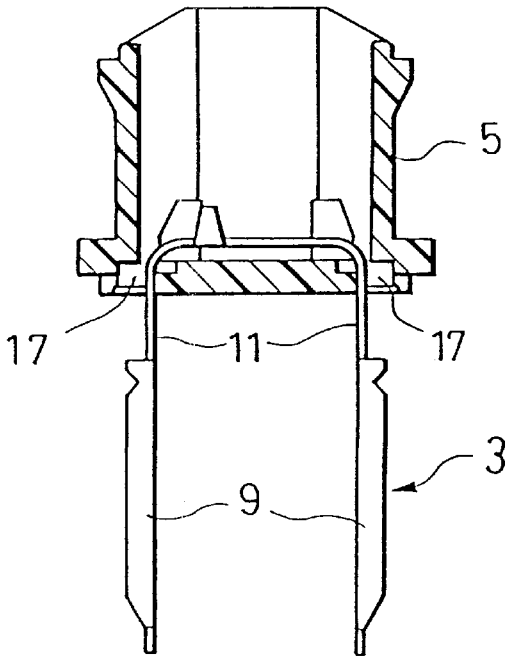
FIG. 5 PRIOR ART
FIG. 5 is a vertical cross-sectional view showing the process of inserting a fuse element of the fusible link of FIG. 4.
Figure 6:
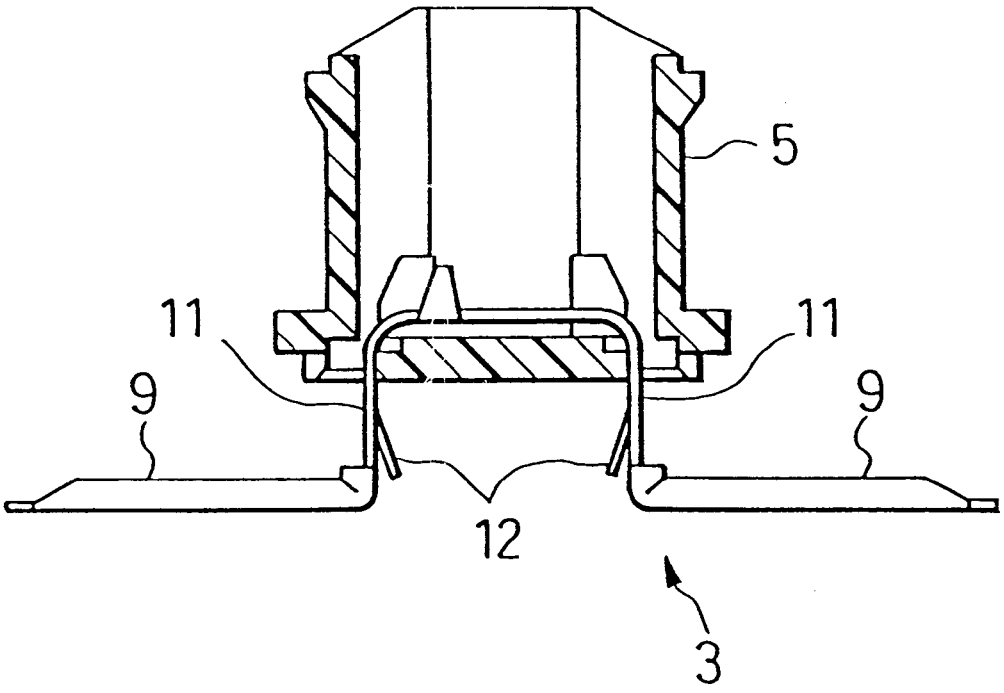
FIG. 6 PRIOR ART
FIG. 6 is a vertical cross-sectional view showing the process of bending terminal portions of the fusible link of FIG. 4.

The operation of the fusible link 31 of the above construction will now be described. FIG. 3 is a vertical cross-sectional view showing a fuse-melted condition. When the fusible portion 51 of the fusible link 31 is melted upon application of excess current, the fuse element 33 is divided or separated into two portions or sections by a melted portion 69.

For exchanging the thus melted fusible link 31, the bolts (not shown), respectively fixing the terminal portions 45 to the electrical connection portions 43, are first loosened, and then the fusible link 31 is lifted (in a direction of arrow a in FIG. 3) to be detached.

At this time, the two (right and left) portions of the fuse element 33, separated from each other by the melted portion 69, are held within the insulating housing 35, with the pivot pawls 53 resting respectively on the seat surfaces 61, and therefore when the fusible link 31 is lifted, these two portions of the fuse element 33 are pivotally moved in directions of arrows b about the pivot pawls 53 because of the weights of the terminal portions 45. As a result of the pivotal movement of the terminal portions 45 in the directions of arrows b, the opposed edges of the melted portion 69 are moved away from each other.

In the melted fusible link 31, the terminal portions 45 are inclined as shown in FIG. 3, and can be pivotally moved about the pivot pawls 53, and therefore the melting of the fuse element can be easily confirmed with the eyes through the transparent cover 37.

As described above, in this fusible link 31, the pivot pawls 53, serving as the pivot points, are formed on each of the leg plates 49 of the fuse element 33, and the pivot pawls 53 are supported respectively on the seat surfaces 61 formed on the spacer 39, and the pivotal movement-allowing spaces 67*a* and 67*b* are formed in the insulating housing 35 and the spacer 39. Therefore, when the fuse is melted, the two portions of the fuse element, separated from each other, are pivotally moved respectively by the weights of the terminal portions 45, so that the opposed edges of the melted portion 69 are moved away from each other. As a result, when exchanging the fusible link 31, the opposed edges of the melted portion 69 will not contact each other, thereby preventing the short-circuiting.

After the fusible link 31 is melted, the two portions of the fuse element, separated from each other, are pivotally moved about the pivot pawls 53, so that the terminal portions 45 are inclined, and can be pivotally moved. Therefore, the melting of the fusible link 31 can be confirmed not only with the eyes through the transparent cover 37 but also by the condition of the terminal portions 45.

In the above embodiment, although the insulating housing 35 and the spacer 39 are separate from each other, the present invention can be applied to a fusible link of a construction as described above in the prior art, in which through holes are formed through the bottom wall of the housing, and straight terminal portions are passed respectively through these through holes, and then are bent, thereby fixing the fuse element to the insulating housing, and in this case, also, by providing the pivot pawls 53, the seat surfaces 61 and the pivotal movement-allowing spaces 67*a* and 67*b*, similar effects as described above can be achieved.

As described in detail, in the fusible link of the present invention, the pivot pawls, serving as the pivot points, are provided on the fuse element, and the pivot pawls are supported respectively on the seat surfaces, and the pivotal movement-allowing spaces for allowing the pivotal movement of the fuse element are provided in the insulating housing. Therefore, when the fuse is melted, the two portions of the fuse element, separated from each other, can be pivotally moved respectively by the weights of the terminal portions, so that the opposed edges of the melted portion can be moved away from each other. Therefore, when exchanging the fusible link, the opposed edges of the melted portion will not contact each other, thereby preventing the short-circuiting. After the fuse element is melted, the terminal portions are inclined, and can be pivotally moved, and therefore the melting of the fusible link can be confirmed not only with the eyes but also by the condition of the terminal portions.

What is claimed is:

1. A fusible link comprising:

a fuse element having a pair of terminal portions, leg plates perpendicular to the terminal portions and interconnected by a fusible portion, and the fuse element having two pairs of pivot pawls, each pair of said pivot pawls formed at a lower end portion of each of the leg plates, and projecting perpendicularly to leg plates;

a spacer having seat surfaces respectively supporting the pivot pawls thereon to hold the fuse element within an insulating housing, wherein the spacer includes a tapering surface slating downwardly away from the leg plate; and pivotal movement-allowing spaces for allowing two portions of the fuse element, separated from each other when the fusible portion is melted, to be pivotally moved about the pivot pawls inside and outside the insulating housing.

2. A fusible link as claimed in claim 1, wherein the spacer includes a tapering surface slanting downwardly away from the leg plate.

3. A fuse element comprising:

a pair of terminal portions, each terminal portion having a mounting hole;

leg plates perpendicular to the terminal portions, and extending upwardly respectively from opposed edges of the pair of terminal portions;

a fusible portion interconnecting uppers ends of the leg plates; and two pairs of pivot pawls, each pair of said pivot pawls formed at a lower end portion and at an outer edge of each of the leg plates, and projecting perpendicularly to leg plates.

4. A fuse element as claimed in claim 3, wherein said fuse element is symmetrical with respect to said fusible portion.

5. The fuse element of claim 3, wherein the pivotal movement of the fuse element communicates melting of the fusible portion.

* * * * *

UNITED STATES PATENT AND TRADEMARK OFFICE

CERTIFICATE OF CORRECTION

PATENT NO. : 5,929,739

DATED : July 27, 1999

INVENTOR(S) : Mitsuhiko TOTSUKA

It is certified that error appears in the above-identified patent and that said Letters Patent is hereby corrected as shown below:

On the title page, item [30]:

Foreign Application Priority Data should read --July 9, 1996 [JP] Japan .....

8-179455--.

Signed and Sealed this

Twenty-first Day of November, 2000

*Attest:*

Q. TODD DICKINSON

*Attesting Officer*

*Director of Patents and Trademarks*